United States Patent [19]

Marshall

[11] 4,016,319

[45] Apr. 5, 1977

[54] BIAXIALLY ORIENTED NONWOVEN FABRIC HAVING LONG AND SHORT FIBERS

[75] Inventor: Preston F. Marshall, Walpole, Mass.

[73] Assignee: The Kendall Company, Boston, Mass.

[22] Filed: Dec. 19, 1975

[21] Appl. No.: 642,669

Related U.S. Application Data

[63] Continuation-in-part of Ser. No. 506,843, Sept. 17, 1974, Pat. No. 3,969,561.

[52] U.S. Cl. ..... 428/113; 428/114; 428/213; 428/218; 428/167; 428/171

[51] Int. Cl.[2] ..... B32B 5/12

[58] Field of Search ..... 428/131, 213, 224, 113, 428/114, 167, 171, 218

[56] References Cited

UNITED STATES PATENTS

| | | | |
|---|---|---|---|
| 3,679,535 | 7/1972 | Kalwaites | 428/224 |
| 3,679,536 | 7/1972 | Kalwaites | 428/131 |
| 3,681,182 | 8/1972 | Kalwaites | 428/224 |
| 3,681,184 | 8/1972 | Kalwaites | 428/213 |
| 3,969,561 | 7/1976 | Marshall | 428/113 |

*Primary Examiner*—George F. Lesmes
*Assistant Examiner*—William R. Dixon, Jr.
*Attorney, Agent, or Firm*—Edward J. Scahill, Jr.

[57] ABSTRACT

A nonwoven fabric having alternating stripes of high fiber density and low fiber density has fibers of at least one-half inch in length and fibers of less than one-half inch in length, preferably under one-fourth inch in length. The fabric is made in such a manner as to produce parallel twistless ribbon strands in the high fiber density areas containing both short and long fibers. The twistless ribbon strands are bridged together by the long fibers so as to form the nonwoven fabric. A majority of the bridging long fibers have at least a portion of their length included in adjacent twistless ribbon strands; said ribbon strands having at least one strand width space between said ribbon strands. A majority of said short fibers are disposed in said high fiber density areas together with a majority of said long fibers, both being oriented in substantially one direction, for example, the machine direction, while substantially all of the long fibers in the adjacent and bridging low fiber density areas are oriented in a direction substantially normal to that direction.

11 Claims, 7 Drawing Figures

BIAXIALLY ORIENTED NONWOVEN FABRIC HAVING LONG AND SHORT FIBERS

CROSS-REFERENCE TO OTHER APPLICATIONS

This application is a continuation-in-part of U.S. Ser. No. 506,843, filed Sept. 17, 1974 now U.S. Pat. No. 3,969,561 issued on July 13, 1976.

BACKGROUND OF THE INVENTION

This invention relates to biaxially oriented striped nonwoven fabrics and the method for making same, and more particularly, to a nonwoven fabric having alternating high fiber density and low fiber density striped portions, and fiber mixtures of both long and short fiber lengths, said fabric having substantially biaxial orientation of fibers throughout the fabric.

Nonwoven fabrics are now used for a variety of purposes in a number of industries. These fabrics have been made traditionally by methods such as carding, garnetting, air-laying and the like. Nonwoven webs have been made to have most of the fibers therein oriented in the machine direction; other nonwoven webs have been made to have some cross orientation; and still other webs have been produced having a randomized fiber distribution. However, substantially all of these webs are lacking in any surface character or natural decorative effect. Nowhere in the art, heretofore, has a nonwoven fabric been made having a striped construction wherein half of the stripes have a high fiber density and the other half of the stripes are of low fiber density; furthermore, no fabrics have yet been made in such a striped manner, for example, wherein a majority of the fibers in the high fiber density stripes are oriented in a direction parallel to stripes (machine direction), while a majority of the fibers in the low fiber density stripes are oriented in a direction substantially perpendicular to the stripes (cross direction). No method has yet been devised for manufacturing such a fabric with at least two types of orientation disposed thereon simultaneously.

Furthermore, it has been discovered that while the biaxially oriented nonwoven fabric described above has been very satisfactory in many respects, efforts have been undertaken to attempt to reduce the cost of raw materials therein, while increasing the bulk, softness, feel and look of the resulting nonwoven fabric.

Accordingly, it is an object of the present invention to produce a nonwoven fabric with long and short fibers therein that has a striped patterned construction manufactured into it, which would be able to be produced with relatively inexpensive short fibered materials.

It is another object of this invention to produce a striped nonwoven fabric having alternating stripes of high fiber density and low fiber density.

It is a further object of the present invention to produce a striped nonwoven fabric having alternating high fiber density stripes and low fiber density stripes wherein a majority of the fibers in the high fiber density stripes are oriented in the machine direction while a majority of the fibers in the low fiber density stripes are oriented in the cross direction.

It is still a further object to produce a striped nonwoven fabric wherein the direction of the stripes are running across the fabric or at some other angle that is bias to the angle of the direction of travel of the fabric.

Still another object of the instant invention is to provide a method of manufacturing such a striped nonwoven fabric in a continuous operation.

SUMMARY OF THE INVENTION

By placing lines of fluid impervious materials on or over a moving conveyor screen or collection screen, a nonwoven fabric having alternating stripes of high fiber density areas and low fiber density areas has been produced wherein substantially all of the fibers in the high fiber density stripes are oriented in the direction of the fluid-impervious lines, and substantially all of the fibers in the low fiber density stripes are oriented in a direction substantially normal to that direction. The fibers used in making this nonwoven fabric comprise fibers of at least one-half inch in length and short fibers of less than one-half inch in length, preferably one-fourth in length. Since the short fibers are of insufficient length to bridge the fluid impervious lines or areas, most of them will be deposited with substantially their full length within impervious areas on the collection screen so as to form "twistless ribbon strands". These areas also contain a majority of the long fibers from a fluid-borne stream being fed thereto, while a lesser number of the long fibers bridge across the resist lines or areas and remain in a generally cross direction to those resist areas or lines. A majority of the bridging long fibers have at least a portion of their length included in adjacent high density areas. The nonwoven fabric can be bound together in a number of ways, including the use of thermoplastic fibers as the short fibers therein, so that upon heating said thermoplastic fibers, they will bond the long bridging fibers at their ends where they are incorporated into the stripes but leave the bridging fiber itself substantially free of binder between the stripes, thus enhancing the drape and softness in these areas, while increasing the bulk of the high fiber density areas.

DESCRIPTION OF THE PREFERRED EMBODIMENTS

Figure 1:
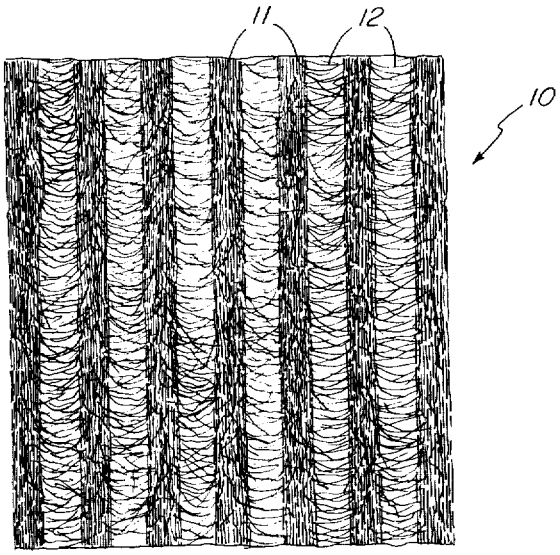
FIG. 1 is a plan view of an embodiment of the nonwoven fabric of this invention.

Referring to FIG. 1 of the drawings, there is shown a nonwoven fabric 10 having alternating high fiber density stripes 11 and low fiber density stripes 12. As can be seen in the drawing, the majority of the fibers in the high fiber density stripes 11 are oriented in a direction that substantially follows the direction of a moving conveyor belt upon which such a fabric is made (machine direction), that is to say, that those fibers are aligned substantially parallel to the length of the fabric. However, the majority of the fibers in the low fiber density stripes 12 are oriented in a direction that is substantially across the width of the fabric 10 (cross direction orientation), that is to say, these fibers are aligned substantially normal to the fibers in the high fiber density stripes 11 and in bridging relationship with those stripes. These alternating striped portions of varying orientation are formed simultaneously as described below.

Figure 2:
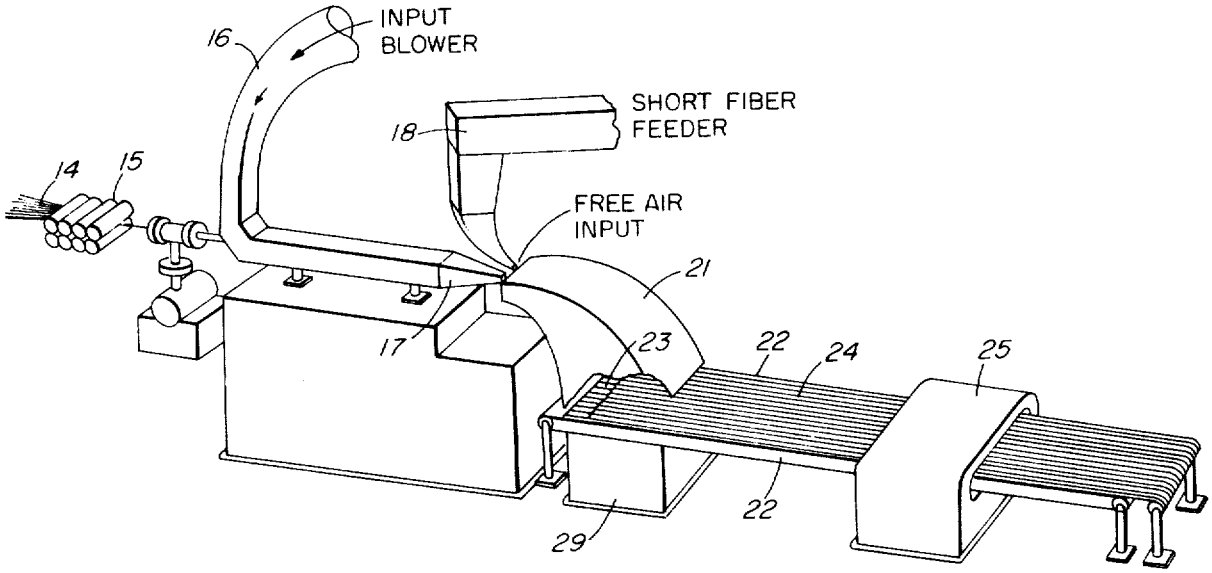
FIG. 2 is a perspective view of the apparatus used to make the nonwoven fabric of this invention.

As shown in FIG. 2, a fluid-borne stream of textile length fibers can be produced by an air-lay machine such as the device described in my U.S. Pat. No. 3,727,270, of common assignee or by other fluids such as water, gas or the like. FIG. 2 shows where textile-length fibers 14 are drafted through a draw frame, such as at 15, and are then propelled by a high velocity air stream provided by input blower 16. The fluid-borne stream of fibers is then guided through a venturi 17 and passed into a distributor chamber 21, further aided by free air pulled in from without the chamber 21. The supply of short fibers is also propelled into the chamber 21 at this point, by means of a short fiber feeder 18. This feeder 18 can be of any conventional type known to those skilled in the art. The fluid-borne stream of both types of fibers passes through the chamber 21 and falls onto a moving conveyor screen 22. Finger-like striping bars 23 can be disposed at regular intervals across the width of the moving conveyor screen 22 in a permanent manner and a suction means, such as the suction box 29, can be positioned beneath the screen 22 and in the area of striping bars 23 so as to aid in causing the fluid-borne stream of fibers to be directed at the striping bars and so as to facilitate the simultaneous formation of crosswise and machinewise orientation of the fibers in the fluid-borne stream. As the fluid-borne stream of fibers falls on the striping bars and the screen they align themselves in a fashion that produces the nonwoven fabric described above. The thusly formed striped web 24 then proceeds to move along the screen 22 and may pass through a heating means, such as at 25, which can serve to cause a melting of thermoplastic fibers which may be present within the web 24 so as to serve as a means for binding the fibers of the web together. Of course, the web may be bonded by any other conventional bonding means known to those skilled in the art of nonwoven fabrics. The web then continues until it is picked up by the takeup roll 26 at the end of the line.

While it is not entirely certain what causes this novel striped fabric to be formed, one theory is now offered. However, it should be pointed out that this invention should not be limited by the theoretical explanation presented here. As the fluid-borne stream approaches the moving screen 22 propelled by a positive pressure induced velocity above the screen and a low pressure below the screen, the fluid must diverge to avoid the stripes positioned across the screen. This divergence would be centered along the center line of each striping bar and above that striping bar. The fluid along either side of that line of divergence would be induced to move outward from the center line of the striping bar. As a result, a fiber approaching the screen would be carried by this divergent fluid and would thus follow its divergence. If a fiber has a portion of its length on one side of the line of divergence and another portion of its length on the other side of the line of divergence, it will suffer a straightening action as its two portions on opposite sides on the line of divergence are forced outward from the striping bars 23. The fibers are then carried down to the moving screen 22 with one portion of the fiber on one side of the striping bar and another portion of the fiber on the other side of the bar. Bridging these two portions of the fiber will be relatively straight section of fiber that bridges the striping bar at approximately 90° to its axis.

Accordingly, it then becomes apparent that it is desirable to have the width of the striping bar less than the length of the fiber to provide a bridging length and two portions of the fibers on either side of the striping bar. It has been noted, however, that there will still be some straightening action and cross orientation effected whenever a fiber bridges both sides of the line of divergence. Further, the striping bars should be of sufficient width so as to cause a divergence that is substantial when compared to a fiber length so as to have a substantial portion of the fiber length straight and oriented along the striping bar.

A majority of fibers, however, will be propelled toward the spaces between the striping bars and those fibers will be pulled forward along the moving screen 22 oriented substantially in a direction parallel to the striping bars 23, thereby producing a webbed fabric as shown and described in FIG. 1 above.

It has been found, for example, that a ⅜ inch wide striping bar produces a high degree of cross orientation with 1½ inch fibers, since it is a substantial width compared to a fiber length, but it is still small enough to permit a number of fibers to both bridge the striping bar and still have length remaining to distribute on either side of the striping bar. If the striping bars are close together so that the distance between the bars is less than a fiber length, and preferably less than one-half a fiber length, the fibers that do not bridge the striping bars will be carried into a high fiber density stripe or space that lies between the striping bars. As described earlier herein, a high fiber density stripe formed by a majority of the fibers is therefore induced to have a primary orientation along the axis of the striping bar. This most probably occurs because there is no restraint on the orientation of a fiber lying parallel to the axis of the stripe, but any fiber attempting to lie across the striping bars is pushed by the divergent air from the striping bars into a conformed position along the striping bar.

Under this theory, the high fiber density stripes that are formed between the blocking or resisting striping bars will be increasingly oriented in the direction of the stripe as the distance between the striping bars is decreased.

Figure 3:
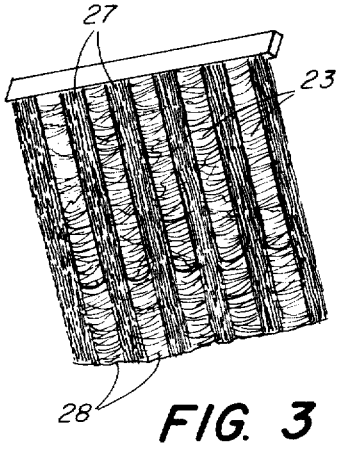
FIG. 3 shows a partial view of the striping bars used in this invention.

FIG. 3 is a close-up of the striping bars 23 and shows a majority of the fibers falling between the striping bars at 27 and being oriented in a direction that is substantially parallel to the striping bars 23. Simultaneously, a minority of the fibers become disposed across the striping bars so as to be oriented in a direction substantially across the width of the fabric, and normal to the axis of the bars, such as is shown at 28.

It has been further found that desirable properties in the nonwoven fabric can be greatly enhanced, while the cost of raw materials used to manufacture same can be greatly reduced. This can be accomplished by using a mixture or blend of long fibers and short fibers in the web; long fibers being defined herein as being one-half inch in length or more, while short fibers are defined herein as being less than one-half inch in length, preferably less than one-quarter inch in length. If short fibers are used with long fibers, the short fibers are unable to bridge the striping bars or resist areas and will, therefore, be deposited with substantially their full length contained within the pervious or permeable areas on the collection screen in the high fiber density areas. Such a composition in the fabric greatly enhances the sharpness or resolution of the stripes as well as increasing the bulk thereof.

The short fibers used herein may be paper fibers, cotton linters, short thermoplastic fibers, or the like, or combinations thereof, so long as the fibers are less than one-half inch in length. Of course, the use of these short fibers recited above is more economical and, therefore, reduces the cost of the final fabric. If short thermoplastic binder fibers are used as the short fibers herein, either plane or mixed with other short fibers, then they too will be drawn into the high fiber density stripes and, when activated, will bond the long bridging fibers at their ends where they are incorporated into the stripes but will leave the bridging fiber substantially free of binder between the high fiber density stripes, thus enhancing drape and softness in those areas.

For the purposes of this invention, these high fiber density areas comprising long and short fibers are referred to as twistless ribbon strands herein, and should have at least one strand width in spacing between strands. While it is true that some short fibers will be found in the low fiber density areas mixed in with the long bridging fibers, a majority of the short fibers will be disposed within the twistless ribbon strands. Therefore, the low fiber density stripes will have a lower total fiber length per unit of area of short fibers therein than the twistless ribbon strands.

Figure 4:
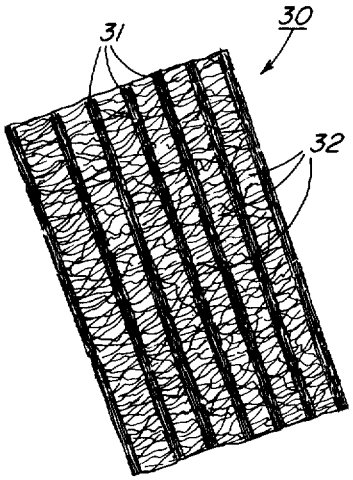
FIG. 4 is a plan view of a nonwoven fabric of this invention using long fiber-short fiber blends therein.

FIG. 4 of the drawings shows a nonwoven fabric 30 of this invention utilizing both long fibers and short fibers. The high fiber density stripes 31 contain a majority of the short fibers and form the so-called twistless ribbon strands. The low fiber density stripes 32 contain a majority of long bridging fibers which are oriented in a direction that is substantially across the width of the fabric, substantially normal to the fibers in the high fiber density stripes or twistless ribbon strands 31. The majority of the fibers in the twistless ribbon strands 31, both long and short alike, are oriented substantially parallel to the length of the fabric 30.

The twistless ribbon strands 31 should have at least one strand width in spacing between strands with bridging long fibers, most of which have at least a portion of their length in adjacent strands, connecting these twistless strands, thereby forming the nonwoven fabric.

Figure 5:
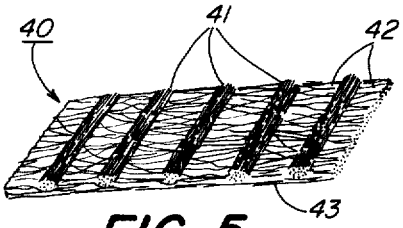
FIG. 5 shows a perspective view of an embodiment of a nonwoven fabric of this invention, said fabric being of a heavier weight than other embodiments described herein.

Referring to FIG. 5, another embodiment of this invention is shown wherein a heavier weight fabric is illustrated. This nonwoven fabric 40 has twistless ribbon strands or high fiber density stripes 41 containing both long and short fibers therein running parallel with the length of the fabric, and low fiber density stripes 42 containing the bridging long fibers and some short fibers intermixed therewith, a majority of fibers in said low fiber density stripes are oriented in a direction substantially normal to the twistless ribbon strands. However, in all but the lightest weight fabrics and as shown in FIG. 4 herein, the top of the fabric 43, that is the portion of the fabric furthest removed from the conveyor screen, appears to be covered by a minor portion of long and short fibers positioned generally across the entire width of the webs. As the fluid-borne stream of fibers positions itself on the screen and striping bars, and becomes increasingly thick and passes off the striping bars, the fluid-borne fibers become less generally controlled by the diverging air, and then fall on the uppermost portions of the fabric in a somewhat randomized or cross oriented fashion (partly because some cross orientation is caused by the fluid-borne stream of fibers being thrown toward the forward wall of the curved chamber). The web at this point can best be described as having high and low fiber density stripes having a somewhat randomized covering layer of long and short fibers integrated therewith. However, a majority of the fibers are still positioned in a striped fashion and in an orientation parallel to the length of the web.

If the striping bars are moved closer together and arranged so that they are spaced three-fourths inch on center rather than on 1 inch centers as described herein earlier, it becomes apparent that a much more pronounced ribbed structure is formed. By "ribbed structure", it is meant that the high fiber density stripes have so many fibers therein that this portion of the web structure becomes almost semi-circular in its construction, while the low fiber density areas remains rather flat. This arrangement could well be described as being a wash-board configuration.

Figure 7:
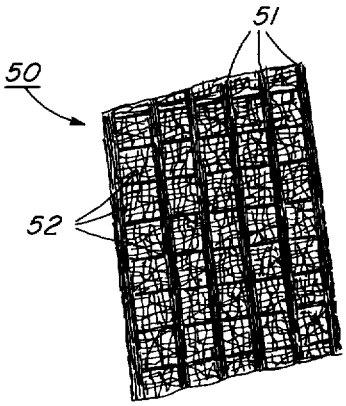

Furthermore, two webs of fabric may be superimposed one on top of the other in a manner as shown in FIG. 7, that the stripes of one web 51 will be at substantially 90° to the stripes 52 of the second web thereby forming a "plaid" fabric such as shown at 50 in FIG. 5. The fabrics of this invention have a variety of uses and could be used as disposable curtains or drapes, decorative narrow ribbons and/or florist ribbons; sweatbands; cling type bandages; disposable tablecloths, and the like.

Figure 6:
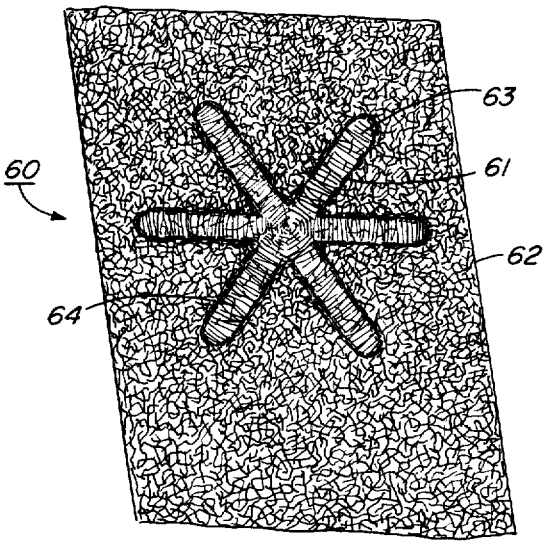
FIG. 6 shows another embodiment of the nonwoven fabric of this invention made with resist areas moving with the screen; and, FIG. 7 is a cut away plan view of still another embodiment of this invention wherein layers of nonwoven fabric are superimposed over each other.

Of course, other designs of striping bars can be used in different arrangements to produce similarly biaxially oriented nonwoven fabrics. For example, impervious resist areas can be designed into the moving conveyor screen as a substitute for the striping bars. As shown in FIG. 6, resist areas 61 can be formed in the shape of a star, or the like, directly on the moving screen 62, so that as the portion of the screen carrying the resist areas passes under the curved chamber and over the suction box, the biaxial orientation of fibers will occur on and around the resist areas on the screen producing a rather unique fabric 60. The resist area 61 will have low fiber density areas 63 wherein the fibers are oriented in a direction substantially across each of the finger-like extensions on the star, while the area of the fabric web directly adjacent the resist area, such as at 64, will have fibers oriented in a direction substantially parallel with the contours of the configuration of the resist area, and the fibers on the rest of the web not affected by resist areas will have a random, cross or machine orientation as desired. Other configurations could also be made on the screen to produce other similar biaxially oriented patterns thereof.

The above webs can be produced by passing fluid-borne streams of the long and short fibers through the apparatus outlined herein before by any method of air-laying fiber webs that is known to those skilled in the art, however, the preferred method is as follows:

Eight vacuum drafting jets of type C as described fully in my earlier patent U.S. No. 3,727,270, of common assignee, having a throat diameter of 0.562 inches were operated at 45 PSIG to 50 PSIG of compressed air at an air consumption of 60 SCFM per jet or at 15 PSIG at an air consumption of 30 SCFM per jet. The jets were supplied with a conventional second draw 60 grain silver, and the silver was fed from a conventional 4 over 4 draw frame set to a draft of 10.

The jets set on 5 inch centers were used to "seed" a column of blower air 40 inch wide and 4½ inches deep. At a distance of 40 inches downstream from the jet the 40 inches wide column of air was reduced by a venturi from 4½ inches deep to 2 inches deep to form a sheet of air travelling at 6,000 feet per minute or 3,333 CFM. This velocity can be adjusted to this level by means of controlling the output of the positive pressure blower.

After leaving the venturi, the sheet of air passed through an open space and was then fed into a distributor chamber or the like having a collection screen approximately 40 inches wide. A suction blower powered by a suction box under the collection screen was adjusted to collect approximately 4,000 CFM per 40 inch of width. Since the suction system was removing more air than was being supplied by the venturi, that amount of free air from the room was drawn in the air gap between the venturi and the distributor. Such a machine operating in the above manner handles 18,000 pounds of air per hour or 4,000 CFM. All of the air but for the 240 CFM used in the jets at 15 PSIG, was supplied by blowers.

The operation of this air-laid system can be further shown by taking an example of a sliver feed rate of 24 feet per minute at the input end of the draw frame. In this case, the original sliver containing approximately 38,265 denier would be drawn down to 3,826 denier by the draw frame and would be about ¾ inch wide and travel at 240 feet per minute.

Assuming that the jet was operating at 15 PSIG it would accelerate the fibers to 24,000 feet per minute and reduce the sliver weight to an average of approximately 38 denier spread over the area of the jet exit 0.6 inches in diameter. This stream of fibers would be expanded and then fed to the venturi where it would contract to 153 denier spread over a venturi exit cross section of 10 square inches or 15.3 denier per square inch.

When eight ends of sliver at 24 feet per minute are fed (one to each jet) over the 40 inch width, the feed rate of the sliver to the machine is 28 grams per square yard and the exit rate at the venturi is 0.112 grams per square yard.

The machine was operated on 3 denier and 1½ denier fibers of about 1½ inch length. The quality level areas observed the various rates of feed and the various jet pressures. From these experiments the generalized conditions for running these fibers were determined in the form of the ratios of pounds per hour, horsepower, air volume, etc. These generalized conditions can be shown on the following chart:

GENERALIZED CONDITIONS FOR AN AIRLAY DISTRIBUTOR (A) AT A REINFORCING GRADE QUALITY LEVEL

| | 3-Den. 1½" | 1½-Den. 1½" |
|---|---|---|
| Distributor Conditions | | |
| Number of Fibers/Cubic foot of air | 6,000 | 12,000 |
| Number of Fibers/Cubic inch of air | 3.5 | 7 |
| Lbs. of air/lb. of fiber | 450 | 450 |
| CFM of air/lb. of fiber per hour | 100 | 100 |
| Jet Conditions at 15 PSIG | | |
| Compressor HP per lb. of fiber/hour | 0.6 | — |
| Lbs. of fiber per hour per jet | 5 | — |
| Jet Conditions at 50 PSIG | | |
| Compressor HP per lb. of fiber/hour | — | 2 |
| Lbs. per fiber per hour per jet | — | 5 |

-continued

GENERALIZED CONDITIONS FOR AN AIRLAY DISTRIBUTOR (B) AT A GOOD QUALITY LEVEL

| | 3-Den. 1½" | 1½-Den. 1½" |
|---|---|---|
| Distributor Conditions | | |
| Number of Fibers/Cubic foot of air | 3,000 | 6,000 |
| Number of Fibers/Cubic inch of air | 1.75 | 3.5 |
| Lbs. of air/lb. of fiber | 900 | 900 |
| CFM of air/lb. of fiber per hour | 200 | 200 |
| Jet Conditions at 15 PSIG | | |
| Compressor HP per lb. of fiber/hour | 1.2 | — |
| Lbs. of Fiber per hour per jet | 2.5 | — |
| Jet Conditions at 50 PSIG | | |
| Compressor HP per lb. of fiber/hour | — | 4 |
| Lbs. of Fiber per hour per jet | — | 2.5 |

This invention will be further explained by means of the following examples:

EXAMPLE I

Eight ends of 38,265 denier rayon sliver of 3 denier per filament 1 9/16 inches long were fed into a fluid-borne stream through eight jet nozzles at an air pressure of approximately 17 PSIG. The rayon is fed into the stream at a rate of 14 grams per square yard and Vinyon fibers of 3 denier and one-fourth inch in length (Vinyon is a tradename for a polymer of vinylacetate and vinylchloride made by American Viscose) are simultaneously fed therein by a ninth jet at a rate of 8 grams per square yard. The stream passes into a curved chamber and the stream of fibers is thrown onto a moving conveyor screen having finger-like striping bars equidistantly disposed from each other across the 42 inch width of the conveyor screen. The striping bars are ⅛ inch wide and are located on ¼ inch centers. Simultaneously, papermakers fibers that have been separated in a pin-type fiberizer or a hammer-mill pass into the curved chamber in a second fluid-borne stream and are simultaneously thrown onto the moving conveyor screen, thereby forming the striped fabric of this invention. A suction under the screen of 6 inches of water assists in the deposition of the fibers on the screen. The web was then processed into a nonwoven by passing the web through an oven at 450° F. This nonwoven fabric had 168 stripes and weighed 26 grams per square yard.

EXAMPLE II

The same fluid-borne stream of rayon and Vinyon fibers as described in Example I was fed through the same equipment at 17 PSIG, and thrown onto the screen under which a suction box or the like exerted a pressure of approximately 6 inches of water. The rayon was fed at a rate of 14 grams per square yard while the Vinyon is fed at a rate of 6 grams per square yard. Simultaneously, a second fluid-borne stream containing papermakers fibers was fed into the curved chamber at a rate of 6 grams per square yard. This fabric weighed 26 grams per square yard, had 168 stripes thereon and was also passed through an oven at approximately 450° F.

EXAMPLE III

The fluid-borne stream as described in Example I was run through the same apparatus as described therein at 17 PSIG. The rayon was fed at a rate of 8 grams per square yard while the Vinyon was fed at approximately 3 grams per square yard. The papermakers fibers were simultaneously fed therein at a rate of 3 grams per square yard, thereby producing a fabric having a total web weight of 14 grams per square yard. The fabric was once more passed through an oven at 450° F and also had 168 stripes thereon.

It is to be understood that many variations of the fabric described herein can be formed by varying the width of the striping bars, the shape of the bars or resist areas, the distances between same, the length of the fibers, and the various types of fiber which is actually used therein. Also, the speed of the moving conveyor (the weight of the fabric) may also alter the characteristics of the web. For example, and as was discussed earlier, a heavier weight web will have a layer of generally randomized or cross-oriented fibers across the uppermost portion of the web fabric.

Many other designs could be achieved using the methods described above by also varying the placement of the striping bars so as to be directly on the collection screen as described above or to be of a more stationary nature and be positioned over the screen. Either will produce various fiber patterns in the area that is covered by the striping bars or resist areas that is highly oriented in a direction substantially normal to the axis of the striping bar.

If the length of the striping bars blocking the screen is reduced so that they do not extend so far as to cover the entire screen collecting surface, then a substantially random web will be formed on the unblocked collection surface causing a random web to become superimposed over and integrally connected with the striped web. The proportion of web weight that is striped and has been biaxially oriented, to the proportion of superimposed web that is random can, of course, be varied by adjusting the proportion of the screen that is blocked by the striping bars.

The striping bars described as preferred in this invention can, of course, be replaced, as described earlier herein, by placing resist areas of impermeability on the screen in the form of bars, or the like. This may be accomplished by placing, for example, strips of tape across the screen or by blocking the openings in the screen in selected areas with a plastic or paint. If these bars are positioned so as to be along the screen's direction of travel, then the resulting striped fabric will be as described in the examples above. However, if the bars are placed across the width of the screen, then the pattern will be reversed so that the stripes will be disposed across the width of the fabric.

Of course, as stated and described herein earlier, resist areas may also be placed at any other angles, other than parallel or normal to the direction of travel of the screen to produce fabrics with stripes at a bias to the direction of travel of the fabrics.

Since it is obvious that many modifications and embodiments can be made in the above described invention without changing the spirit and scope of the invention, it is intended that this invention not be limited by anything other than the appended claims.

What is claimed is:

1. A biaxially oriented nonwoven fabric having long fibers and short fibers therein comprising:

areas of low fiber density and areas of high fiber density, said areas of low fiber density and high fiber density comprising long fibers one-half inch in length or more and short fibers that are less than one-half inch in length, a majority of the fibers in said low fiber density area being long fibers and having a particular configuration and being oriented in a direction substantially normal to the axis of said configuration and, a majority of the fibers in the high fiber density area that lies directly adjacent said low fiber density areas being oriented in a direction substantially parallel with the contours of said configuration of said low fiber density area, a majority of said short fibers being disposed within said high fiber density areas.

2. The biaxially oriented nonwoven fabric of claim 1 wherein said areas of high fiber density and low fiber density are alternating stripes of high fiber density and low fiber density, said stripes running along the length of said fabric, a majority of the fibers in said low fiber density stripes being oriented in a substantially cross direction and comprising long bridging fibers, and a majority of the fibers in said high fiber density stripes being oriented in a direction substantially parallel to said low fiber density stripes, said high fiber density stripes having at least one high fiber density stripe width in spacing between said high fiber density stripes.

3. The biaxially nonwoven fabric of claim 2 wherein said short fibers are less than one-quarter inch in length.

4. The biaxially nonwoven fabric of claim 3 wherein said short fibers comprise at least a proportion of paper fibers.

5. The biaxially nonwoven fabric of claim 3 wherein said short fibers includes at least a proportion of thermoplastic fibers.

6. The biaxially nonwoven fabric of claim 3 wherein said short fibers includes at least a proportion of cotton linters.

7. The biaxially nonwoven fabric of claim 3 wherein said stripes of high fiber density are raised above the plane of the fabric on only one side thereof.

8. The biaxially nonwoven fabric of claim 3 including having both long and short fibers disposed in a generally cross oriented manner across the top of said fabric.

9. The biaxially nonwoven fabric of claim 3 including having both long and short fibers disposed in a randomized manner across the top of said fabric.

10. The biaxially nonwoven fabric of claim 3 wherein another striped fabric is superimposed on the other in a manner such that the stripes of one fabric are disposed at approximately 90° to the stripes of said other fabric.

11. The biaxially nonwoven fabric of claim 3 wherein each stripe of high fiber density includes an area having substantially cross oriented fibers extending therein from across said low fiber density stripes and being secured therein by thermoplastic short fibers.

* * * * *